US011421412B2

(12) United States Patent
de la Corte Mateo et al.

(10) Patent No.: US 11,421,412 B2
(45) Date of Patent: Aug. 23, 2022

(54) SANITARY FIXTURE IN THE FORM OF A TOILET

(71) Applicant: Duravit Aktiengesellschaft, Hornberg (DE)

(72) Inventors: Juan Angel de la Corte Mateo, Haslach (DE); Franziska Sophie Wülker, Gutach (DE)

(73) Assignee: DURAVIT AKTIENGESELLSCHAFT, Hornberg (DE)

( * ) Notice: Subject to any disclaimer, the term of this patent is extended or adjusted under 35 U.S.C. 154(b) by 195 days.

(21) Appl. No.: 16/807,732

(22) Filed: Mar. 3, 2020

(65) Prior Publication Data

US 2020/0284015 A1 Sep. 10, 2020

(30) Foreign Application Priority Data

Mar. 7, 2019 (DE) ..... 10 2019 105 730.2

(51) Int. Cl.
*E03D 11/08* (2006.01)

(52) U.S. Cl.
CPC ..... *E03D 11/08* (2013.01)

(58) Field of Classification Search
CPC ..... E03D 11/08
USPC ..... 4/420
See application file for complete search history.

(56) References Cited

U.S. PATENT DOCUMENTS 1,529,819 A 3/1925 Fleet
5,918,325 A 7/1999 Arita
5,926,863 A 7/1999 Arita
6,986,172 B2 1/2006 Hidetaka
7,325,258 B2 2/2008 Asada
(Continued)

FOREIGN PATENT DOCUMENTS

CN 109339182 A 2/2019
DE 956930 C 1/1957
(Continued)

OTHER PUBLICATIONS

Office Action issued by the Indian Patent Office dated Jan. 19, 2021 regarding the parallel Indian Patent Application No. 202024008944, 6 pages.

(Continued)

*Primary Examiner* — Lori L Baker
(74) *Attorney, Agent, or Firm* — Lucas & Mercanti, LLP; Klaus P. Stoffel

(57) ABSTRACT

A sanitary facility formed as a toilet, including a body with an upwardly open bowl, a water chamber provided in the region of the upper rim of the bowl, to project horizontally into the bowl. Wherein at least one flushing opening on the chamber side directed downwardly into the bowl. At least one connection portion is provided in the rear region of the body for connecting a flushing-water feed line for feeding flushing water into the water chamber, from which the water flows into the bowl via the chamber-side flushing opening. The water chamber extends only in a rear rim region. A second and a third flushing opening are each able to be supplied with flushing water and allow the flushing water to be introduced tangentially into the bowl. The third flushing opening is positioned closer to the front side of the body than the second flushing opening.

20 Claims, 5 Drawing Sheets

(56) References Cited

U.S. PATENT DOCUMENTS

| | | | | |
|---|---|---|---|---|
| 9,702,135 | B2 | 7/2017 | Kashirajima | |
| 10,145,097 | B2 | 12/2018 | McHale | |
| 2003/0115664 | A1* | 6/2003 | Kosugi | B28B 1/002 4/420 |
| 2013/0219606 | A1 | 8/2013 | Grover | |
| 2015/0176264 | A1 | 6/2015 | Kilpeläinen | |
| 2015/0267389 | A1 | 9/2015 | Luettgen | |
| 2017/0275862 | A1 | 9/2017 | Kashirajima | |

FOREIGN PATENT DOCUMENTS

| | | | |
|---|---|---|---|
| DE | 1658261 | A1 | 3/1972 |
| DE | 102014104500 | A1 | 6/2014 |
| EP | 1234921 | B1 | 8/2006 |
| EP | 3054061 | A1 | 8/2016 |
| EP | 1847656 | B1 | 12/2016 |
| JP | 2016014316 | A | 1/2016 |
| JP | 201574875 | A | 11/2016 |
| WO | 2004020753 | A2 | 3/2004 |
| WO | 2005085538 | A1 | 1/2008 |

OTHER PUBLICATIONS

CNIPA issued an Office Action dated Jan. 26, 2021 regarding the parallel Chinese Patent Application No. 202010152993.X, 4 pages.
Canadian Patent Office issued Office Action dated Apr. 20, 2021 regarding the parallel Canadian Patent Application No. 3,074,606, 4 Pages.
CNIPA issued Office Action dated Aug. 17, 2021 regarding the parallel Chinese Patent Application No. 16/807732 including English translation, 9 Pages.

* cited by examiner

SANITARY FIXTURE IN THE FORM OF A TOILET

CROSS-REFERENCE TO RELATED APPLICATIONS

The present application claims priority of DE 10 2019 105 730.2, filed Mar. 7, 2019, the priority of this application is hereby claimed and this application is incorporated herein by reference.

BACKGROUND OF THE INVENTION

The invention relates to a sanitary facility in the form of a toilet, comprising a body with an upwardly open bowl region, a water chamber provided in the region of the upper rim of the bowl region, said water chamber projecting into the bowl region as seen horizontally, wherein at least one flushing opening directed downwardly into the bowl region is provided on the chamber side, and at least one connection portion, provided in the rear region of the body, for connecting a flushing-water feed line for feeding flushing water into the water chamber, from which the flushing water flows into the bowl region via the at least one chamber-side flushing opening.

Known toilets, be they wall-mounted or floor-mounted toilets, often have what is known as a flushing rim, which is formed via a water chamber, which extends all the way round in the region of the upper bowl rim and into which water is introduced via a flushing-water feed line connected thereto. The water is distributed in the annular water chamber, i.e. the flushing rim, from where it can emerge via generally a multiplicity of flushing openings that are directed downwardly into the bowl region. The water thus flows vertically downward out of the underside of the encircling flushing water channel and flows along the bowl surface to the outlet. This vertical component of the flow direction of the flushing water results in effective submerging of the objects to be flushed away.

In order to flood the annular flushing water channel, and, respectively, the relatively large water chamber, as quickly as possible with flushing water, in modern toilets, a connection portion for connecting a pump is provided, via which the flushing water is passed into the water chamber under much greater pressure compared with simple gravity flushing, as it is known, where the water flows in from a water tank or cistern without pump support.

However, a problem with such conventional toilets with a flushing rim is that, as a result of the overhanging shape thereof, which is directed more or less horizontally toward the bowl interior, the underside of the flushing rim and the bowl surface directly beneath the flushing rim are poorly accessible for cleaning purposes.

In order to remedy this, toilets are known that do not have a conventional, encircling flushing rim, these also frequently being referred to as "rimless toilets". Such toilets work with an effectively rotating, vortex-like flushing water flow, which is generally referred to as tornado flushing. The water is fed to the bowl surface horizontally and substantially tangentially via at least one water outlet opening. Although in this case there is no longer a rim that entails cleaning problems, effective discharge of the objects to be flushed away is often insufficient on account of the water flow introduced mostly horizontally into the bowl region, since, on account of the horizontal flushing direction, a sufficient downwardly directed movement component of the flow is lacking. Either this results in incomplete flushing away or more water is required for flushing away.

SUMMARY OF THE INVENTION

Therefore, the invention is based on the problem of specifying an improved sanitary facility in the form of a toilet, which not only allows reliable flushing away but is also easy to clean.

According to the invention, in order to solve this problem in the case of a sanitary facility of the type mentioned at the beginning, the water chamber extends only in a rear rim region, and a second and a third flushing opening that each allow the water to be introduced tangentially into the bowl region are provided, wherein the third flushing opening is positioned closer to the front side of the body than the second flushing opening.

Thus, in the toilet according to the invention, there is both a known flushing water feed from the previous flushing rim, with a vertical flow component, and horizontal flushing, known from tornado flushing, tangential to the bowl surface for tornado flushing. In order to make this possible, the water chamber extends, as seen from the front side of the toilet, only in a rear rim region of the bowl, wherein the bowl is usually embodied in a rounded manner in the front and rear regions and is either straight or curved at the sides. The water chamber thus extends only in the rear, rounded region but not along the sides and the front region. The water chamber has the at least one first flushing opening, wherein, of course, a plurality of such individual openings can be provided in a manner distributed along the length of the water chamber. This region is located, as seen from the side, relatively close to the drain of the toilet. The flushing water flows vertically downward via the one or more first flushing openings and passes, after a short flow path, into the drain region, from where the water reaches the wall-side waste pipe via a U-bend. The flushing water fed via the first flushing opening also has a vertical flow component, associated with a relatively high inflow rate, since the flow path, as stated, is very short. This vertical flow component is important for rapid submersion of the objects to be flushed away and thus for rapid downward flushing away.

Since, however, the water chamber is located only in the rear region of the bowl, the rest of the bowl rim region can consequently be embodied in a chamber-free manner, i.e. in a rimless manner, such that this region is very readily accessible for cleaning purposes. In order to flush out this region, in addition to the at least one first flushing opening, dual tornado flushing is provided, which is realized via a second and a third flushing opening. These two flushing openings allow the water to be introduced tangentially into the bowl region. The two flushing openings can likewise be fed via the water chamber, which accordingly supplies the first, the second and the third flushing opening. Alternatively, a separate water inflow to these two flushing openings can also be provided, i.e. the water chamber is fed via one flushing water inflow and the two flushing openings are fed via another flushing water inflow, for example realized via a pipe arrangement that branches off from a central inflow pipe.

According to the invention, the second and the third flushing opening, as seen in the circumferential direction around the bowl region, are now positioned in an offset manner with respect to one another. The second flushing opening is located closer to the rear region of the bowl, or of the body, and the third flushing opening is located closer to the front region, or the front side, of the bowl, or of the body. This makes it possible to introduce flushing water tangentially at two different positions and thus to ensure that the tangentially introduced flushing water, which naturally has the tendency to also flow away downwardly after being introduced, to nevertheless flush out and clean the top side of the bowl region very extensively on account of the tangential movement component. This effectively dual tornado flushing, which starts at two offset positions, allows very good flushing of the lateral and front bowl regions and provides the additionally required quantity of water for downwardly flushing away the objects to be flushed away in conjunction with the quantity of flushing water that is fed via the one or more first flushing openings and provides the required vertical component.

The toilet according to the invention is therefore distinguished by a very good flushing effect, since two different flushing techniques are advantageously combined with one another, and the respective regions where the different flushing techniques are applied are coordinated appropriately with one another. This is because the "conventional" chamber flushing with a downwardly directed flow is provided only in the rear region, very close to the drain, and cleans this rear bowl region. By contrast, the lateral and front bowl regions are served via the dual tornado flush, which is introduced into the bowl region at two offset positions. Furthermore, on account of the otherwise rimless configuration of the upper bowl rim, i.e. without an inwardly projecting rim, very good cleanability is provided.

This toilet according to the invention creates in particular the possibility of providing a very good cleaning effect by combined flow techniques in the case of simple gravity flushing. In the case of such gravity flushing, the water is fed from a water tank or cistern, from which it flows via the underside. In other words, the water pressure that is present in the water tank or cistern via the water column determines the flushing pressure. Use is not made of a flushing-water supply device comprising a pump, via which pump the flushing-water pressure can be set at an appropriately high level. As a result of the realization of the two, second and third flushing openings that are axially offset as seen in the direction of the longitudinal center plane of the body, in the case of this gravity flushing, the relatively low water pressure nevertheless ensures that full flushing is possible via the tornado flush in all lateral and front regions. This is because the introduction of flushing water at two different positions ensures that the flushing water arrives even in regions that are farther away, as seen in the introduction direction, and can clean there. In other words, in the case of this toilet according to the invention, in spite of a lower water pressure and thus flushing pressure on account of the pump-free gravity flush, tornado flushing is possible, in which the water flowing out flushes the entire bowl surface.

Preferably, the second and the third flushing opening are fed with flushing water jointly from the water chamber. According to this configuration of the invention, both the first flushing openings and the second and the third flushing opening are supplied jointly from the water chamber, and so only a central flushing water connection to the water chamber needs to be provided. Alternatively, however, it is also conceivable to provide a separate water inflow to these two flushing openings, i.e. for the water chamber to be supplied via one flushing water inflow and the two flushing openings to be supplied via another flushing water inflow. This can be realized for example via a pipe branch of the Y-pipe type, which is connected to a central flushing-water inflow pipe and by one end to the water chamber and by the other end to a connection, via which the second and the third flushing opening are supplied. The water chamber with the first flushing openings and the body portion with the connection and the second and third flushing opening would then be separated.

In a development of the invention, it is possible for the second and the third flushing opening to lead out in a common water guiding portion that extends at least partially around the bowl region, is laterally open toward the bowl region and is formed on the body. This water guiding portion, which may have an angular or rounded cross section, serves to guide the flushing water fed for tornado flushing partially around at a higher level in the introduction direction and in this way to effectively transport it into the farther-away regions. The water guiding portion is formed for example via a horizontally protruding shoulder, which provides a water running surface along which the water flows. Of course, after flowing out, in spite of being guided in the water guiding portion, a certain quantity of flushing water flows downward, this being necessary in order to flush the regions located immediately next to the flushing openings. Nevertheless, via the water guiding portion, it is possible to ensure that a sufficient quantity of water is still transported onward at a relatively high bowl level and can clean farther-away regions. Since the second and the third flushing opening lead into a common water guiding portion, the formation of only one such channel is accordingly also necessary.

The water guiding portion may extend through at least 180° as far as the opposite side of the bowl region, but may also, starting from one side of the water chamber, extend as far as the other side of the water chamber or even to some extend under the latter. This makes it possible to keep a certain amount of flushing water longer at a sufficient height and to guide it round, even though, as mentioned, the flushing water also flows down permanently along the entire channel length.

As described, the second and the third flushing opening are likewise preferably fed with flushing water from the water chamber. For this purpose, the second flushing opening can be provided on the chamber side in addition to the first flushing opening, but, unlike the vertically downwardly directed first flushing opening, it is turned more or less through 90° so as to be open horizontally toward the front.

In order to supply the third flushing opening, which is farther away in terms of position, with water, according to the invention a channel is provided, with which the water chamber communicates, wherein this channel leads out at the third flushing opening. The channel, which may have a round or angular cross section, extends substantially tangentially to the bowl contour and therefore does not have any abrupt deflections, since it necessarily adjoins one end of the water chamber and from there follows the geometry of the bowl. Via this effectively closed channel, the flushing water coming from the water chamber can easily be guided relatively far even to a considerably spaced-apart third flushing opening virtually without any pressure loss, such that, when the second and third flushing opening are positionally coordinated appropriately, an optimal cleaning result is achieved. The water emerging via the second flushing opening can clean one associated bowl region, while the flushing water emerging from the third flushing opening primarily cleans the adjoining further bowl region.

The channel is expediently closed on all sides, apart from the chamber-side feed opening and the end-side flushing opening. Alternatively, it is also possible for only a gully to be provided, which is closed on its top side by a cover, but is partially open toward the bowl interior. Such a cover engaging over the channel or such a wall can preferably be realized via the inwardly extended bowl rim, wherein this inwardly extended bowl rim can also bound the water guiding portion on its top side, such that splashing over is prevented via the protrusion, formed in this way, engaging over the water guiding portion.

As regards the arrangement of the channel with respect to the third flushing opening, various configurations are conceivable. According to a first invention alternative, the channel can extend laterally next to and farther toward the outside than the water guiding portion. The two thus extend parallel to one another and in a radially offset manner with respect to one another, wherein the water guiding portion, which is open toward the bowl, is of course located farther toward the inside. Alternatively, the channel can also extend above or beneath the water guiding portion. Here, too, the two channels necessarily extend in a parallel manner, but at different heights.

According to an expedient development it is possible for the cross section of the channel to decrease at least partially toward the third flushing opening. As a result of a decrease in the channel cross section, a nozzle effect is achieved as it were, meaning that there is a rise in the dynamic pressure toward the third flushing opening and accordingly the flushing water emerging there emerges under higher pressure. This higher pressure is in turn advantageous for guiding the flushing water round as far as possible.

In a particularly expedient development, a wall bounding the channel simultaneously forms a boundary for the water guiding portion. Depending on the arrangement of the two channels with respect to one another, this wall can be a lateral boundary wall of the channel when the two channels are located horizontally next to one another, or the upper or lower boundary wall of the channel when the channels are arranged one above the other.

In order to arrange the two channels as close together as possible and to keep the configuration as a whole as compact as possible, it is expedient for the second flushing opening to be arranged next to an outlet opening of the water chamber, which is adjoined by the channel. In other words, two openings that are located immediately next to one another are provided in the water chamber, specifically the second flushing opening, located farther toward the inside as seen for example radially, and the outlet opening, located radially farther toward the outside, which leads directly into the channel.

According to one development of the concept of the invention, it is also possible to provide a fourth flushing opening, which is downstream of the third flushing opening as seen in the direction of the water fed to the third flushing opening and which is either fed with flushing water from the channel or at which a separate channel that communicates with the water chamber opens out. According to this configuration of the invention, the tornado flush is supplemented by a further flushing opening, which is positioned in an even more offset manner with respect to the second flushing opening. This fourth flushing opening can be supplied from the same channel as the one that also feeds the third flushing opening with flushing water, but it is also conceivable to lead a separate channel thereto, which likewise communicates with the water chamber. This channel can optionally also extend on the other bowl side, meaning that the flushing water from the fourth flushing opening is fed in the opposite direction to the flushing water from the second and third flushing openings.

As described, in the sanitary facility, gravity flushing without pump support and without additional jet flushing is provided. In order to allow a simple connection to such a water tank or cistern, the connection portion is expediently provided centrally with regard to a vertical longitudinal center plane of the body, wherein the water chamber extends on one or both sides of the longitudinal center plane. Preferably, the water chamber extends of course on both sides of this longitudinal center plane, in order to flush as large a rear region of the bowl as possible via the conventional, vertical flush that is executed thereby.

The second flushing opening and the channel are expediently provided on one side of the centrally arranged water chamber. As stated above, the water guiding portion can be bounded on its top side by a protrusion that extends preferably substantially horizontally and is directed toward the inside of the bowl region and on its bottom side by a bowl-side shoulder. In this way, the water guiding portion is defined. It is configured as it were in a recessed manner into the bowl surface, as seen horizontally. In this case, the protrusion can be formed via the rim, extended toward the inside of the bowl region, of the bowl region itself. If the channel is arranged laterally parallel to the water guiding portion, this rim, extended toward the inside, of the bowl region can at the same time also form the cover of the channel. In other words, the bowl rim not only covers the channel but also at the same time defines the water guiding portion or, respectively, bounds the top side thereof with respect to splashing.

In a development, it is possible for the depth of the water guiding portion to decrease toward the end. In other words, the downwardly bounding shoulder or edge tapers off, while on the top side, the protrusion remains for reasons of symmetry or appearance. As a whole, a narrower or shorter shoulder or edge is thus provided, such that less dirt can accumulate in such a region but can be readily removed on account of the good accessibility.

Although it is possible to provide only one first flushing opening, for example in the form of an elongate arcuate opening in the form of a slot or the like, it is expedient to provide a plurality of first flushing openings, which are arranged preferably in an arcuate row. These first flushing openings, for example in the form of round punched holes, are distributed across the width of the water chamber, in order to bring about wetting of the bowl surface over as large an area as possible.

The second, third and optionally fourth flushing opening can likewise be embodied as rounded openings, but it is also conceivable for them to be embodied as slots or the like.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
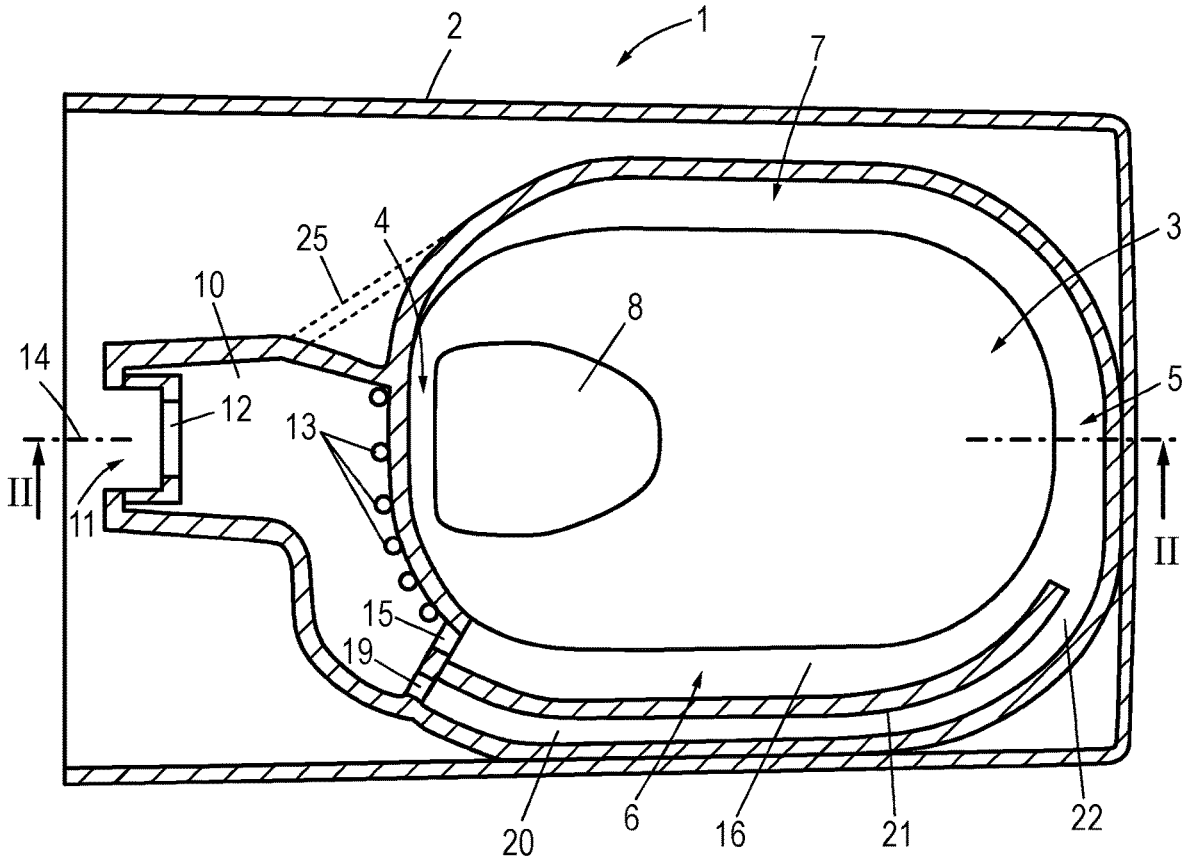
FIG. 1 shows a schematic illustration, in horizontal section, of a sanitary facility according to the invention in the form of a toilet.
Figure 2:
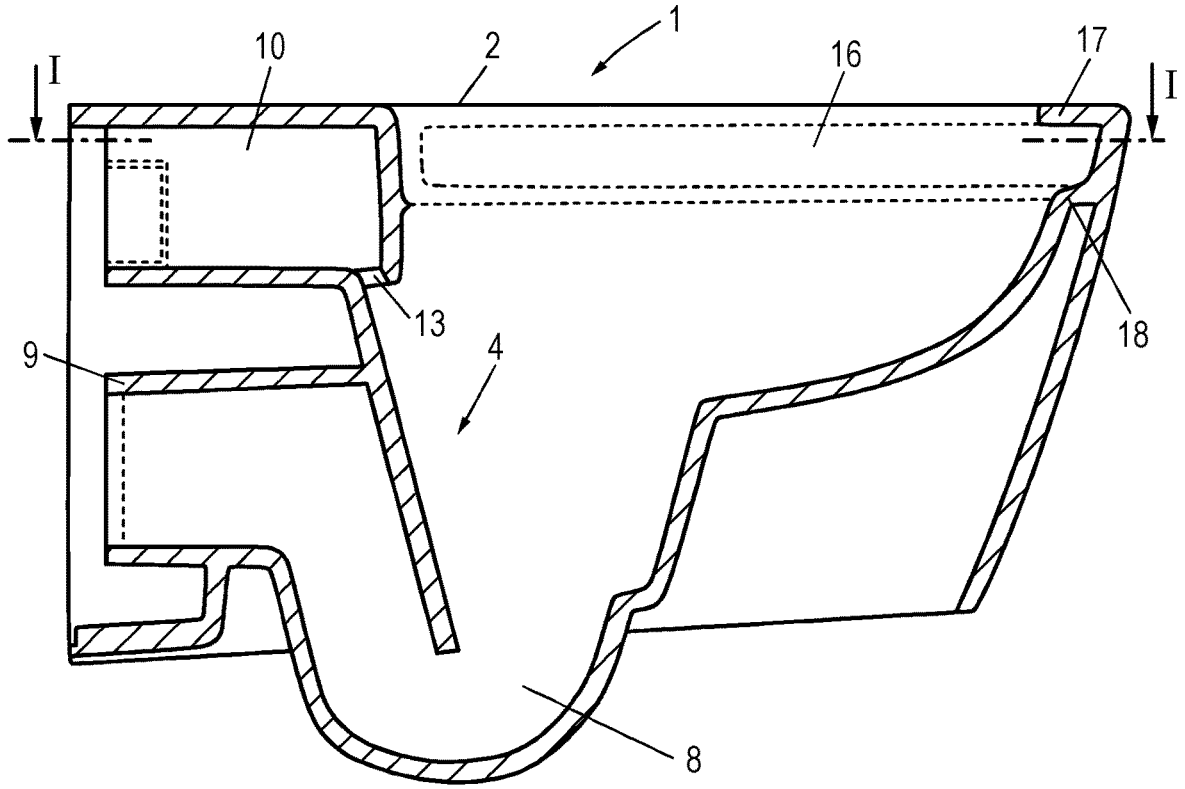
FIG. 2 shows a vertical section through the toilet in FIG. 1.

FIGS. 1 and 2 show a sanitary facility 1 according to the invention in the form of a toilet in a horizontal section (FIG. 1) and a vertical section (FIG. 2). The sanitary facility 1 consists of a body 2 having a bowl region 3, comprising a rear region 4, a front region 5 and mutually opposite lateral regions 6, 7. The bowl region 3 leads out at a drain 8 in the underside, which (see FIG. 3) leads out in a waste pipe 9 to which a sewage pipe can be connected. The toilet itself can be floor-mounted or, as here, be embodied as a wall-mounted toilet.

Provided is a water chamber 10, which has a rear connection portion 11 with a feed opening 12, via which flushing water, which is fed by a flushing-water feed line, which is intended to be connected to the connection portion 11, can flow into the water chamber 10. The flushing-water feed line comes from a water tank or cistern, which is mounted in a manner known per se above the toilet, usually behind a wall.

The water chamber extends exclusively in the rear region 4 of the bowl region 3 and projects (see FIG. 2) to some extent into the bowl region 3. In the region of this protrusion, a plurality of first flushing openings 13 are provided in the exemplary embodiment shown, which (see FIG. 2) are open vertically downwardly, such that flushing water located in the water chamber 10 can flow vertically downward into the region 4 and clean the latter.

The water chamber 10 is arranged centrally with respect to the longitudinal center plane 14, such that a central supply connection is made via the feed opening 12. The water chamber 10 extends to the left-hand side, as seen from the front, in the sectional top view according to FIG. 1. It would be conceivable, as indicated by the dashed line 25, for it also to extend somewhat to the opposite side and for further first flushing openings 13 to be able to be provided in this region.

Provided in the region of the left-hand end of the water chamber is a second flushing opening 15, which is more or less vertical and is open toward the front. It allows tornado flushing, since water emerging from the water chamber 10 via the second flushing opening 15 is introduced horizontally and tangentially into the bowl region 3. The flushing water emerging here passes into a water guiding portion 16, which (see also FIG. 2) extends, starting at the end of the water chamber, around the circumference of the bowl region 3 in the upper region of the bowl rim 17 and runs as far as the opposite end of the water chamber 10, optionally also to some extent beneath the latter. The water guiding portion 16 is formed via for example a horizontally protruding shoulder, which provides a water running surface along which the water flows. Over the top side of the water guiding portion 16 there engages an inwardly extended protruding rim 17, which bounds the water guiding portion 16 upwardly and serves as a splash guard. Downwardly, the water guiding portion 16 is bounded via a protruding shoulder 18, which likewise extends round. Although, in the exemplary embodiment shown, the water guiding portion 16 extends all the way round, it is likewise conceivable to also configure it to extend round to a lesser extent, such that the shoulder 18 narrows toward the channel end and tapers out in the surface of the bowl. This water guiding portion 16 serves, since it extends close to the rim at the upper bowl rim, to guide the water flowing into it at an appropriate height for as long as possible. The water flows out of the second flushing opening 15 with the flushing pressure defined via the water column in the water tank or cistern. Although a part already flows down to the side into the bowl region 3 or the lateral region 6 after flushing out, a considerable part is transported further in the circumferential direction, wherein water continuously flows downward, of course, throughout the transport. However, in any case, the water running surface formed via the shoulder 18 makes it possible to guide the flushing water as far as possible in the circumferential direction, such that a relatively large area of the bowl region 3 can already be flushed via the water emerging from the second flushing opening 15.

As FIG. 1 shows, provided next to the second flushing opening 15 and laterally farther out than the latter is an outlet opening 19, which leads into a channel 20. This channel 20 extends parallel to the water guiding portion 16 and is separated therefrom via a partition wall 21, which bounds the water guiding portion 16. The channel 20 is likewise engaged over by the bowl rim 17, and the latter forms as it were the upper channel cover. The partition wall 21 can adjoin this protruding rim 17 such that the channel 20 is closed on all sides, but it can also be spaced apart therefrom. In any case, however, the bowl rim 17 also extends somewhat farther and engages over that part of the water guiding portion 16 that is next to the channel 20.

The channel 20 leads out at a third flushing opening 22, which is evidently, as seen in the circumferential or flushing-water feed direction, clearly offset from the second flushing opening 15. While the second flushing opening 15 is located at the transition from the rear region 4 to the lateral region 6, the third flushing opening 22 is positioned already in the front region 5. Since the third flushing opening 22 communicates with the water chamber 10 via the channel 20 and the outlet opening 19, the flushing water is consequently likewise present in the channel 20, and thus the third flushing opening 22, with the corresponding pressure defined via the water level in the water tank or cistern, and is flushed out there likewise horizontally and tangentially to the bowl surface and introduced into the water guiding portion 16. In other words, both flushing openings 15 and 22 introduce the flushing water into the water guiding portion 16, which is open toward the bowl region 3, but at positions that are clearly spaced apart with respect to the longitudinal center plane 14.

The flushing water fed via the third flushing opening 22 is guided a long way around via the water guiding portion 16, although, of course, a certain part thereof continuously flows downward via the flushing path and cleans the bowl surface. However, by being guided around, a sufficient amount of water also passes into the region 7 and further and can flow away and provide cleaning there.

In other words, in the case of the toilet according to the invention, via the one flushing-water inflow via the connection opening 12 and the common water chamber 10, both the first flushing openings 13 and the second and third flushing openings 15, 22 are supplied with flushing water. Combined flushing from different flushing techniques thus takes place, specifically conventional flushing from the downwardly directed flushing openings 13 and tornado flushing via the flushing openings 15 and 22, with these being initiated at two different points, however. As described, it is a matter of gravity flushing, in which the flushing water is fed from the water tank or cistern only under relatively low pressure. Since the tornado flushing is initiated at two clearly offset positions, as seen more or less in the axial or in the longitudinal direction of the bowl region 3, via the second and third flushing openings 15, 22, it is possible to ensure that, in spite of a lower water pressure, the flushing water flushes out the basin region 3 all around, in particular including in the region 7 that is farthest away from the second and third flushing openings 15 and 22. This flushing that combines different flushing techniques ensures that the flushing water not only flows away with a sufficiently strong vertical component resulting from the amount of flushing water, which flows away via the first flushing openings 13, so as to clean the rear region 4 but also so as to submerge objects to be flushed away. Furthermore, a powerful and extensive flushing out of the bowl region 3 is ensured via the tornado flushing that is initiated as it were twice, and at the same time, in this way, the quantity of water required to complete flush away the objects is also fed.

Figure 3:
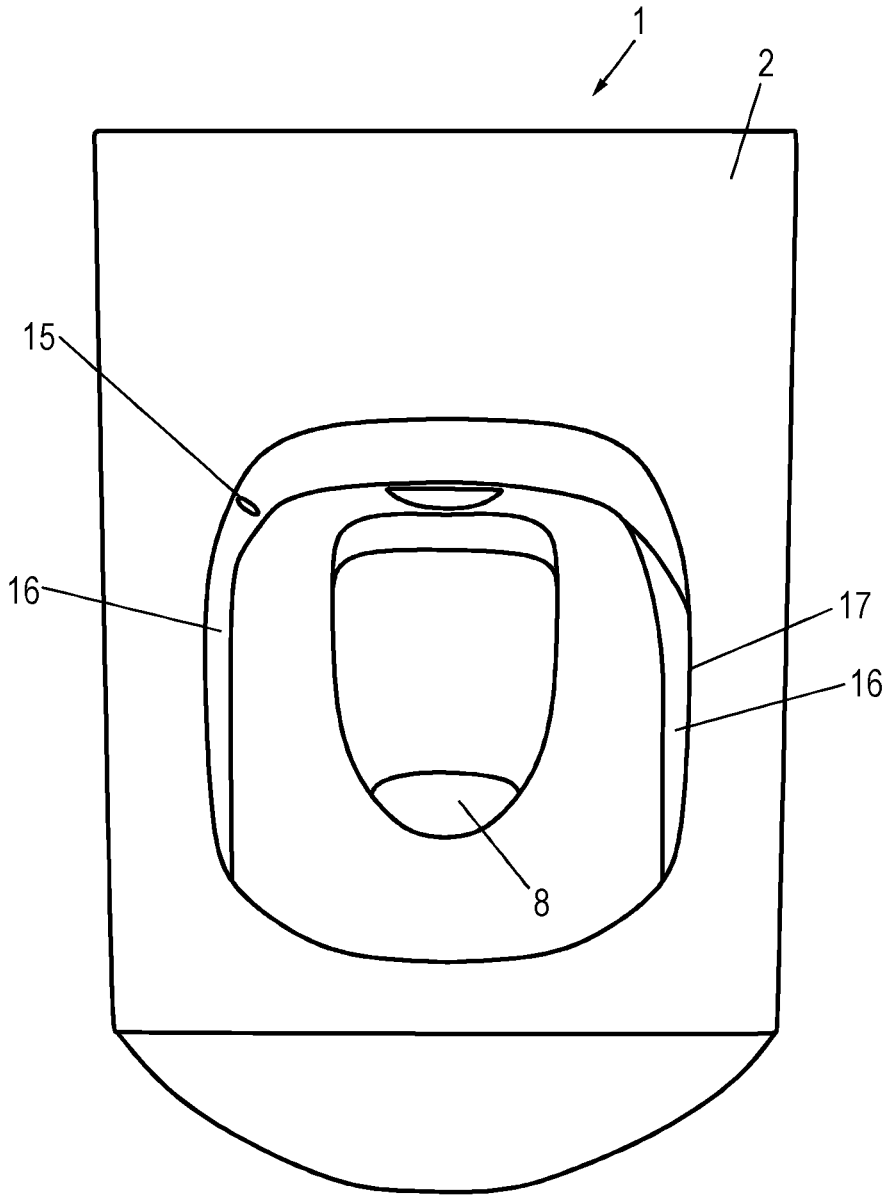
FIG. 3 shows a perspective top view of a toilet according to the invention.
Figure 4:
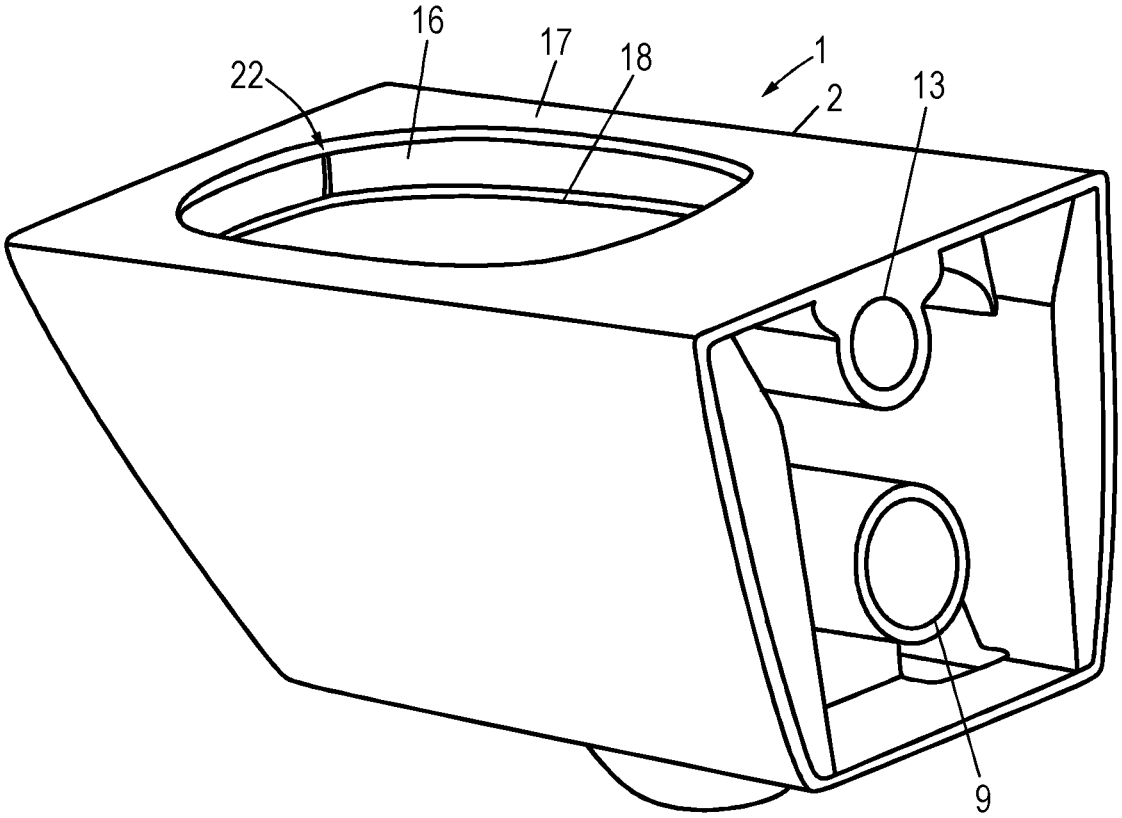
FIG. 4 shows a perspective side view of the toilet in FIG. 3.

FIGS. 3 and 4 show two perspective views of the sanitary facility 1, or toilet, with its body 2 in a top view (FIG. 3) and a perspective side view (FIG. 4). FIG. 3 shows the second flushing opening 15 and part of the water guiding portion 16 adjoining the latter, which can also be seen on the opposite side. As can be seen, the water guiding portion 16 is engaged over via the inwardly extending bowl rim 17.

By contrast, FIG. 4, which likewise shows the water guiding portion 16, reveals the third flushing opening 22, which likewise leads out in the water guiding portion 16. The two flushing openings 15, 22 are illustrated as elongate, slot-like flushing openings. Via the opening geometry, a certain increase in the dynamic pressure can be achieved, likewise by the circumstance that the channel 20 can also narrow somewhat in cross section toward the front end having the third flushing opening 22.

Figure 5:
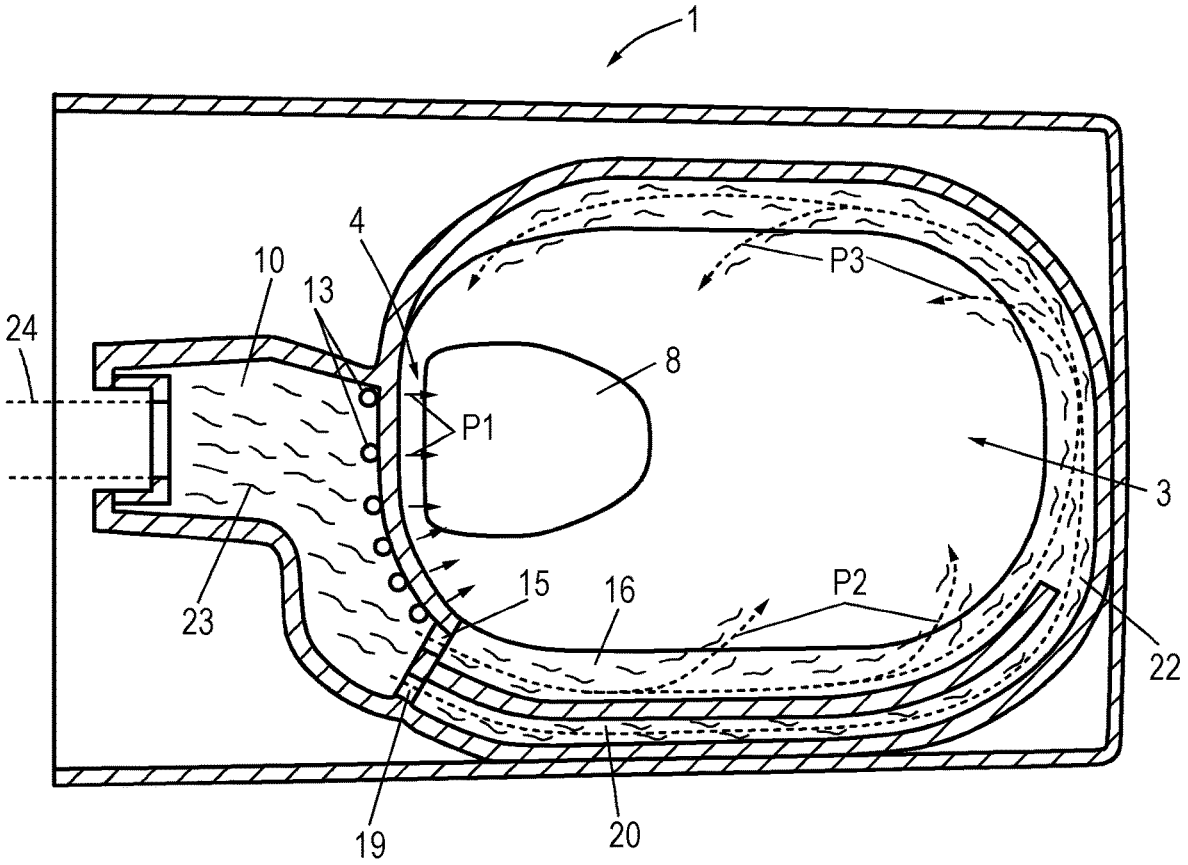
FIG. 5 shows a schematic illustration, corresponding to FIG. 1, for elucidating the flow of flushing water.

FIG. 5 shows the sanitary facility 1, or the toilet, during a flushing operation. The water chamber 10 is filled with flushing water 23, which has flowed in via the flushing-water feed line (indicated only by way of dashed lines here). From the first flushing openings 13, the flushing water flows, as illustrated by the arrows P1, vertically downward along the rear region 4 and reaches the drain 8.

At the same time, however, the flushing water flows from the second flushing opening 15 tangentially into the water guiding portion 16 and flows there, guided via the water guiding portion 16, along or, as also illustrated by the arrows P2, down into the bowl region 3.

Likewise at the same time, the flushing water flows via the outlet opening 19 into the channel 20 and from the third flushing opening 22 likewise into the water guiding portion 16 and along the latter, and also, as illustrated via the arrows P3, down into the bowl region 3.

As can be seen, on account of this guided tornado flush, the flushing water is successfully guided to all regions of the bowl that need to be cleaned, and flushing also takes place in the rear region 4 via the downwardly flowing flushing water.

The position of the third flushing opening 22 is of course variable; it can be arranged somewhat closer to the second flushing opening 15 or farther away from the latter. It is also conceivable to provide a fourth flushing opening, i.e. to open the channel 20 in the region of the third flushing opening 22 but also to continue it and guide it to a fourth flushing opening, provided for example in the region 7, such that flushing water can additionally be output there too. Equally, it is also conceivable, via an additional channel that proceeds from the other side of the water chamber 10, to guide water to a fourth flushing opening, wherein the flushing-out opening would then be in the opposite direction to that of the flushing openings 15 and 22.

Although, in the exemplary embodiment shown, the water guiding portion 16 and the channel 20 are arranged next to one another, as seen horizontally, it is also conceivable to position the water guiding portion 16 beneath the channel 20 or to position the channel 20 beneath the water guiding portion 16, and this would result in a correspondingly different arrangement of the second flushing opening 15 and of the outlet opening 19.

While specific embodiments of the invention have been shown and described in detail to illustrate the inventive principles, it will be understood that the invention may be embodied otherwise without departing from such principles.

We claim:

1. A sanitary facility in the form of a toilet, comprising a body with an upwardly open bowl region, a water chamber provided in the region of an upper rim of the bowl region, said water chamber projecting into the bowl region as seen horizontally, wherein at least one flushing opening directed downwardly into the bowl region is provided on the chamber side, and at least one connection portion, provided in the rear region of the body, for connecting a flushing-water feed line for feeding flushing water into the water chamber, from which the flushing water flows into the bowl region via the at least one chamber-side flushing opening, wherein the water chamber extends only in a rear rim region, and wherein a second and a third flushing opening that are each able to be supplied with flushing water and each allow the flushing water to be introduced horizontally and tangentially into the bowl region are provided, wherein the third flushing opening is positioned closer to the front side of the body than the second flushing opening.

2. The sanitary facility according to claim 1, wherein the second and the third flushing opening are fed with flushing water jointly from the water chamber.

3. The sanitary facility according to claim 1, wherein the second and the third flushing opening lead out in a common water guiding portion that extends at least partially around the bowl region, is laterally open toward the bowl region and is formed on the body.

4. The sanitary facility according to claim 3, wherein the water guiding portion extends through at least 180° as far as the opposite side of the bowl region.

5. The sanitary facility according to claim 4, wherein the water guiding portion extends as far as the other side of the water chamber or under the water chamber.

6. The sanitary facility according to claim 1, wherein the second flushing opening is provided on the chamber side in addition to the first flushing opening, and in that the water chamber communicates with a channel that leads out at the third flushing opening.

7. The sanitary facility according to claim 6, wherein the channel is closed on all sides.

8. The sanitary facility according to claim 6, wherein the channel extends laterally next to and farther toward the outside than the water guiding portion.

9. The sanitary facility according to claim 6, wherein the channel extends above or beneath the water guiding portion.

10. The sanitary facility according to claim 6, wherein the cross section of the channel decreases at least partially toward the third flushing opening.

11. The sanitary facility according to claim 6, wherein a wall bounding the channel simultaneously forms a boundary for the water guiding portion.

12. The sanitary facility according to claim 6, wherein the second flushing opening is arranged next to an outlet opening of the water chamber, which is adjoined by the channel.

13. The sanitary facility according to claim 1, wherein a fourth flushing opening is provided, which is downstream of the third flushing opening as seen in the direction of the flushing water fed to the third flushing opening and which is either fed with flushing water from the channel or at which a separate channel that communicates with the water chamber opens out.

14. The sanitary facility according to claim 6, wherein the connection portion is provided centrally with regard to a vertical longitudinal center plane of the body, and the water chamber extends on one or both sides of the longitudinal center plane.

15. The sanitary facility according to claim 14, wherein the second flushing opening is provided on one side of the centrally arranged water chamber and the channel adjoins.

16. The sanitary facility according to claim 6, wherein the water guiding portion is bounded on its top side by a protrusion directed toward the inside of the bowl region and on its underside via a bowl-side shoulder.

17. The sanitary facility according to claim 16, wherein the protrusion is formed via the rim, extended toward the inside of the bowl region, of the bowl region.

18. The sanitary facility according to claim 17, wherein the rim, extended toward the inside, of the bowl region simultaneously forms the cover of the channel.

19. The sanitary facility according to claim 1, wherein the horizontal depth of the water guiding portion decreases toward the end.

20. The sanitary facility according to claim 1, wherein a plurality of first flushing openings are provided, which are arranged preferably in an arcuate row.

* * * * *